US008469747B2

(12) United States Patent
Huang

(10) Patent No.: US 8,469,747 B2
(45) Date of Patent: Jun. 25, 2013

(54) CARD CONNECTOR

(75) Inventor: Sheng-Yuan Huang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 160 days.

(21) Appl. No.: 13/183,404

(22) Filed: Jul. 14, 2011

(65) Prior Publication Data

US 2013/0017731 A1 Jan. 17, 2013

(51) Int. Cl.
*H01R 24/00* (2011.01)

(52) U.S. Cl.
USPC ..... 439/629

(58) Field of Classification Search
USPC ..... 439/629, 946, 159, 638, 152; 361/752, 361/796
See application file for complete search history.

(56) References Cited

U.S. PATENT DOCUMENTS

| | | | | |
|---|---|---|---|---|
| 6,097,605 | A * | 8/2000 | Klatt et al. | 361/737 |
| 7,014,484 | B2 * | 3/2006 | Hagiwara | 439/159 |
| 7,909,251 | B2 * | 3/2011 | Yi et al. | 235/451 |
| 2006/0086792 | A1 * | 4/2006 | Chen et al. | 235/441 |

* cited by examiner

*Primary Examiner* — Jean F Duverne
(74) *Attorney, Agent, or Firm* — Cheng-Ju Chiang

(57) ABSTRACT

Provided is a card connector, including a housing and a plurality of electrical contacts. The housing includes an upper housing and a lower housing connected each other. The upper housing and the lower housing together define a first opening and a second opening, which are layer-stacked and separately located two adjacent sides of the housing. The first and second openings are communicated each other in the housing to form a receiving cavity for stackedly accommodating at least two electrical cards. The upper housing disposes a plurality of contact-receiving grooves on an inner side of a top wall thereof, and the lower housing also disposes a plurality of contact-receiving grooves on an inner side of a bottom wall thereof. The electrical contacts include a first electrical contact group and a second electrical contact group, which are separately received in the contact-receiving grooves of the upper housing and the lower housing.

7 Claims, 5 Drawing Sheets

CARD CONNECTOR

BACKGROUND OF THE INVENTION

1. Field of the Invention

The present invention relates to a connector, and more particularly to a SIM (Subscriber Identity Module) card connector.

2. Description of the Prior Art

A SIM card connector is widely applied to various electronic communication devices, such as mobile phone and so on. The SIM card connector is mounted on a circuit board and a SIM card is inserted therein, so that signals can be transmitted between the SIM card and the circuit board, thereby identifying the date.

FIG. 1 shows a prior SIM card connector 50, which comprises a housing 51. The housing 51 disposes a plurality of receiving grooves 511 on a bottom wall thereof for holding a plurality of electrical contacts 512. The electrical contacts 512 are soldered on a circuit board (not shown in FIG. 1) and electrically connected thereto. The SIM card connector 50 further comprises a retaining member 52 mounted on the housing 51. A receiving cavity is defined between the retaining member 52, the bottom wall of the housing 51 and two sidewalls of the housing 51 for allowing a SIM card 53 to be inserted therein.

However, because the tendency of the electronic communication devices such as mobile phone and so on are toward light, thin and small, the SIM card connector applied thereto also should be developed toward light, thin and small. But the above prior SIM card connector 50 has a large size and may occupy a larger space of the electronic communication device, so it cannot satisfy the present factual demands. Moreover, the prior SIM card connector 50 only allows one SIM card to be inserted therein, so it cannot satisfy the dual-cards-two-standby function of the present mobile phone.

BRIEF SUMMARY OF THE INVENTION

An object of the present invention is to provide a card connector, which can accommodate two cards and has a compact structure.

To achieve the above object, in accordance with the present invention, a card connector is provided, comprising a housing and a plurality of electrical contacts received in the housing. The housing comprises an upper housing and a lower housing connected each other. The upper housing and the lower housing together define a first opening and a second opening, which are layer-stacked and separately located two adjacent sides of the housing. The first and second openings are communicated each other in the housing to form a receiving cavity for stackedly accommodating at least two electrical cards. The upper housing disposes a plurality of contact-receiving grooves on an inner side of a top wall thereof, and the lower housing also disposes a plurality of contact-receiving grooves on an inner side of a bottom wall thereof. The electrical contacts comprise a first electrical contact group and a second electrical contact group, which are separately received in the contact-receiving grooves of the upper housing and the lower housing.

Based on the above description, the card connector of the present invention has a compact structure. The housing of the card connector of the present invention is obtained by mounting the upper and lower housings. The card connector has the first opening and the second opening, which are separately located on the two adjacent sides of the housing and provided for allowing the two SIM cards to be inserted therein along two perpendicular directions, so that making the mobile phone or other electronic communication devices realize the dual-cards-two-standby function. Furthermore, the card connector 1 of the present invention can save the inside space of the mobile phone or other electronic communication devices, which are toward light and thin. Additionally, when the two SIM cards are inserted into the housing of the card connector of the present invention, they can stably contact with the electrical contacts so that ensuring the better communications transmission.

DETAILED DESCRIPTION OF THE PREFERRED EMBODIMENTS

The following embodiment with reference to the accompanying drawings now has been given for detail describing the technology, the feature, the object and the effect of the present invention.

Figure 1:
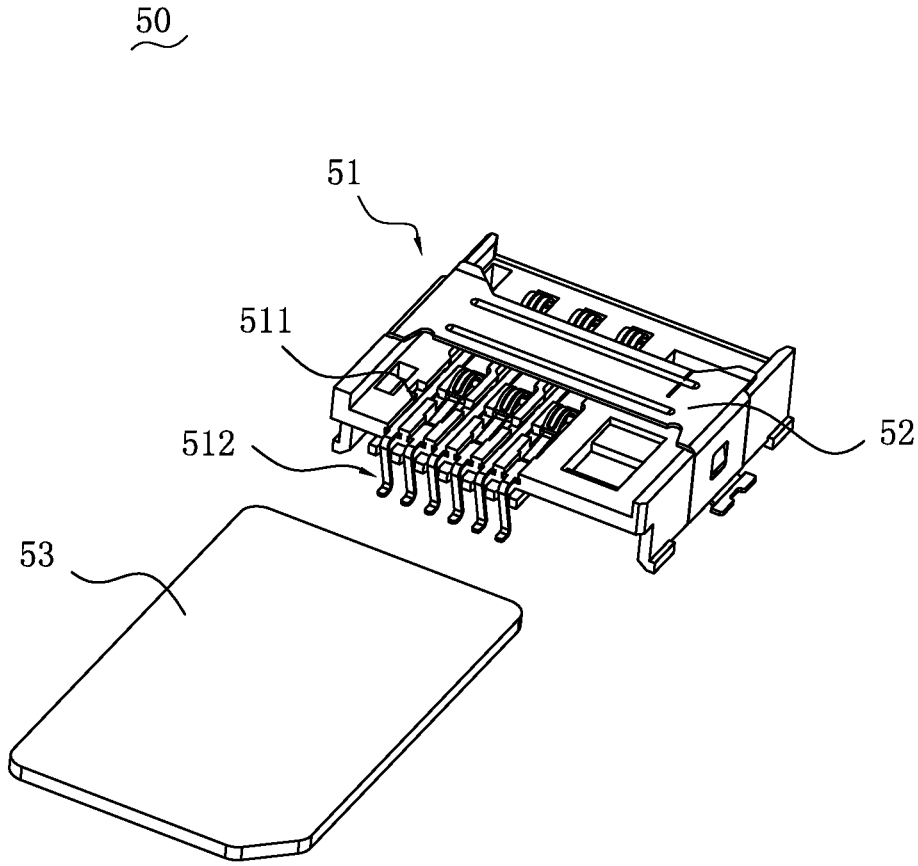
FIG. 1 (Prior Art)
FIG. 1 is a perspective view of a prior SIM card connector.
Figure 2:
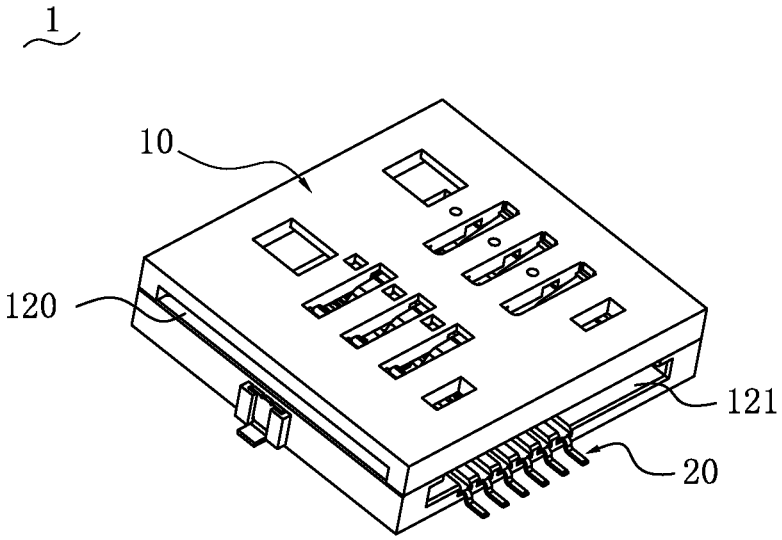
FIG. 2 is a perspective view of a card connector according to one embodiment of the present invention.
Figure 3:
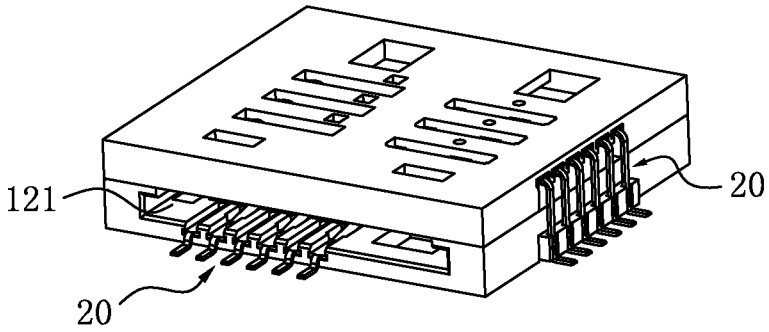
FIG. 3 is another perspective view of the card connector shown in FIG. 2.
Figure 4:
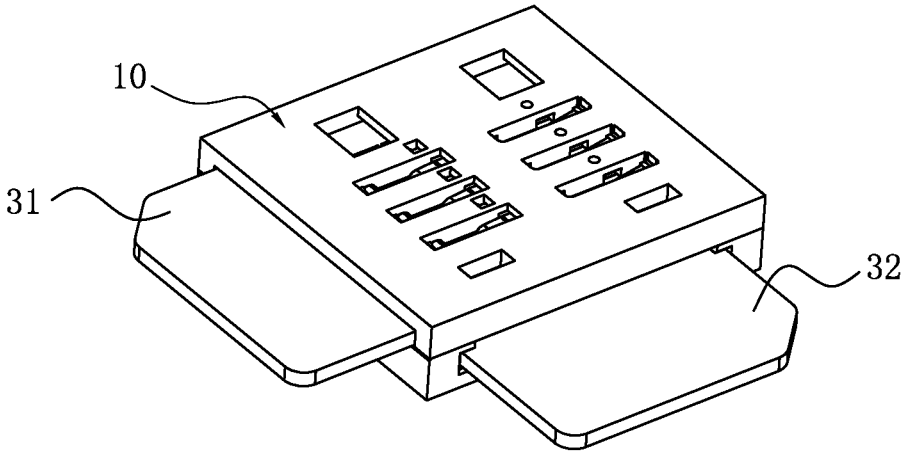
FIG. 4 is a perspective view showing that two SIM cards are inserted into the card connector of FIG. 2.

Referring to FIGS. 2 to 4, a card connector 1 of the present invention comprises a housing 10 and a plurality of electrical contacts 20. In this embodiment, the card connector 1 is provided for accommodating SIM cards. One end of each electrical contact 20 is received in the housing 10 for contacting with the SIM card, and the other end thereof extends out of the housing 10 for being soldered on the outer circuit board (not shown in all FIGS.). When the SIM card is inserted into the card connector 1, the effective positions for transmitting singles on the SIM card can contact with the electrical contacts 20 so that forming a communication connection between the SIM card and the outer circuit board. For the design of the present invention, the card connector 1 may be provided for accommodating two SIM cards, such as a first SIM card 31 and a second SIM card 32 shown in FIG. 4, so that making the mobile phone or other electronic communication devices realize the dual-cards-two-standby function.

Referring to FIGS. 2 to 5, the housing 10 is substantially a square shape in a plan view, which comprises an upper housing 11 and a lower housing 13. The upper housing 11 and the lower housing 13 mounted together form a first opening 120 and a second opening 121, which are layer-stacked. The first opening 120 and the second opening 121 are communicated each other in the housing 10 to form a receiving cavity (not shown), which is provided for allowing the two SIM cards to be inserted therein. Preferably, the first opening 120 and the second opening 121 are separately located on two adjacent sides of the housing 10, so that the first SIM card 31 and the second SIM card 32 can be separately inserted therein along two perpendicular directions.

Figure 5:
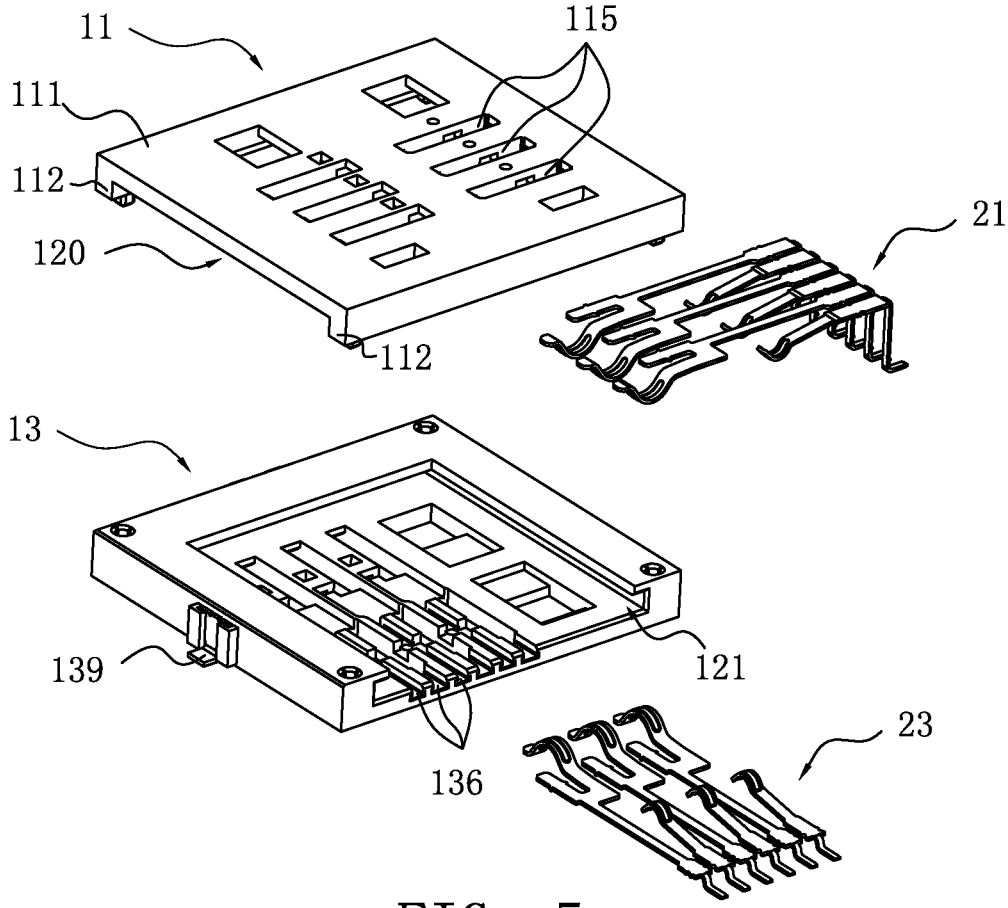
FIG. 5 is an exploded perspective view of the card connector of FIG. 2.
Figure 6:
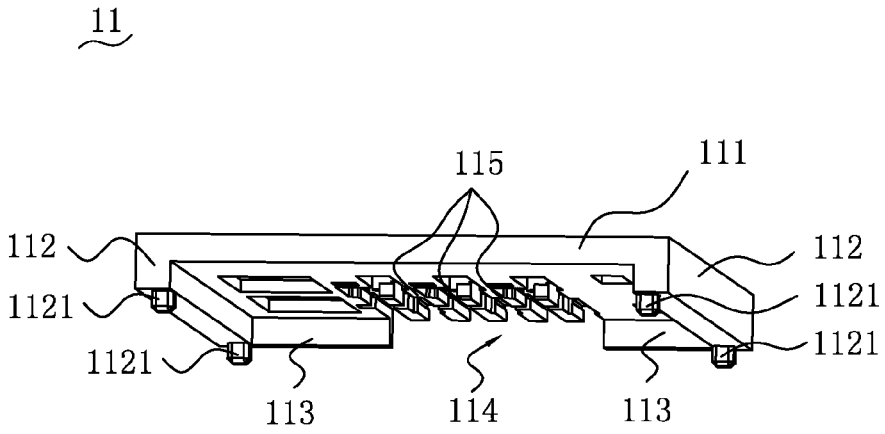
FIG. 6 is a perspective view of an upper housing of the card connector shown in FIG. 4.

Specifically, referring to FIGS. 5 and 6, the upper housing 11 is a half closed shape having a top wall 111, two engaging portions 112 separately extending downward from a left and right sides of the top wall 111, and two detached blocking portions 113 formed on the rear of the top wall 111 and forming a space 114 therebetween. One of the two blocking portions 113 is connected to one of the two engaging portions 112, and the other of the two blocking portions 113 is connected to the other of the two engaging portions 112. When the first SIM card 31 is inserted into the housing 10 from the first opening 120, the two blocking portions 113 can block the tail of the first SIM card 31 from further moving forward. Each engaging portion 112 disposes at least one post 1121 to cooperate with the upper housing 11 and the lower housing 13 in assembly. Preferably, the number of the posts 1121 is four. These posts 1121 are distributed on two ends of each engaging portion 112. The top wall 111 of the upper housing 11 disposes a plurality of contact-receiving grooves 115 on the inner side thereof for receiving a first electrical contact group 21. Preferably, the contact-receiving grooves 115 extend to the rear of the upper housing 11, so that one end of each electrical contact of the first electrical contact group 21 is received in the corresponding contact-receiving groove 115, and the other end thereof extends out of the rear of the upper housing 11 for being connected to the outer circuit board.

Figure 7:
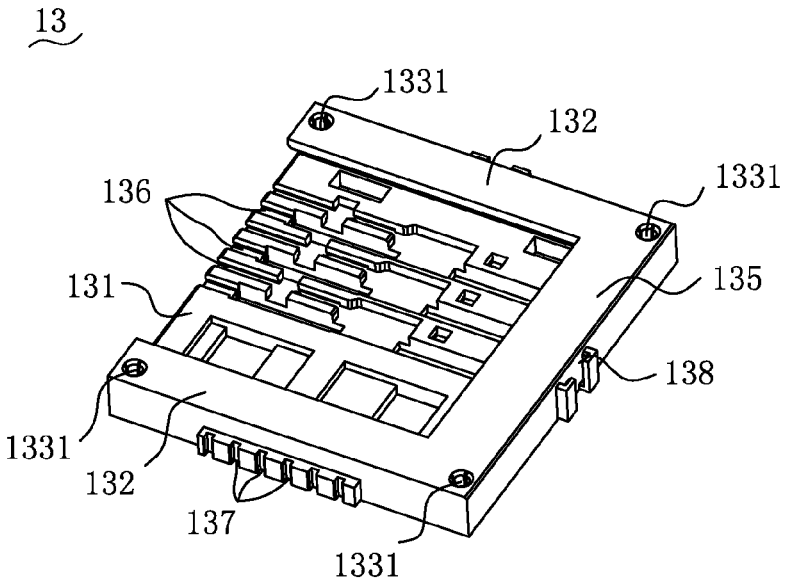
FIG. 7 is a perspective view of a lower housing of the card connector shown in FIG. 4.

Similarly, referring to FIGS. 5 and 7, the lower housing 13 also is a half closed shape, which has a bottom wall 131 and two mating portions 132 separately extending upward from a left and right sides of the bottom wall 131. Preferably, the two mating portions 132 dispose a plurality of holes 1331 corresponding to the positions of the posts 1121 of the two engaging portions 112. When the upper housing 11 and the lower housing 13 are assembled, the two engaging portions 112 of the upper housing 11 are perpendicularly mounted on the two mating portions 132 of the lower housing 13, so that the first opening 120 of the upper housing 11 is corresponding to one of the mating portions 132 of the lower housing 13, and one of the engaging portions 112 of the upper housing 11 is corresponding to the second opening 121 of the lower housing 13. Now, the posts 1121 are separately inserted into the corresponding holes 1331 thereby realizing a detachable connection. The assembly mode of the upper housing 11 and the lower housing 13 can not be limited to this, but can also employ other fasteners, such as bolt and so on. Additionally, the lower housing 13 disposes a resisting portion 135, which is connected between the two mating portions 132, on the rear thereof. When the second SIM card 32 is inserted from the second opening 121, the resisting portion 135 can block the tail of the second SIM card 32 from further moving forward.

As shown in FIGS. 5 and 7, the bottom wall 131 of the lower housing 13 disposes a plurality of contact-receiving grooves 136 on the inner side thereof for receiving a second electrical contact group 23. Preferably, the contact-receiving grooves 115 extend to the front of the lower housing 13, so that one end of each electrical contact of the second electrical contact group 23 is received in the corresponding contact-receiving groove 136, and the other end thereof extends out of the front of the lower housing 13 for being connected to the outer circuit board. Moreover, there is a plurality of holding grooves 137 on the side surface of one of the mating portions 132. When the upper housing 11 carrying the first electrical contact group 21 is connected to the lower housing 12, the tails of the first electrical contact group 21 are embedded into the holding grooves 137 for the convenience of being soldered.

Preferably, two retaining grooves 138 are separately disposed on the resisting portion 135 and one of the mating portions 132 of the lower housing 13. Please refer to FIG. 5, one end of an L-shaped fixing member 139 is embedded into the retaining groove 138 of the mating portion 132, and the other end thereof extends out of the mating portion 132.

Figure 8:
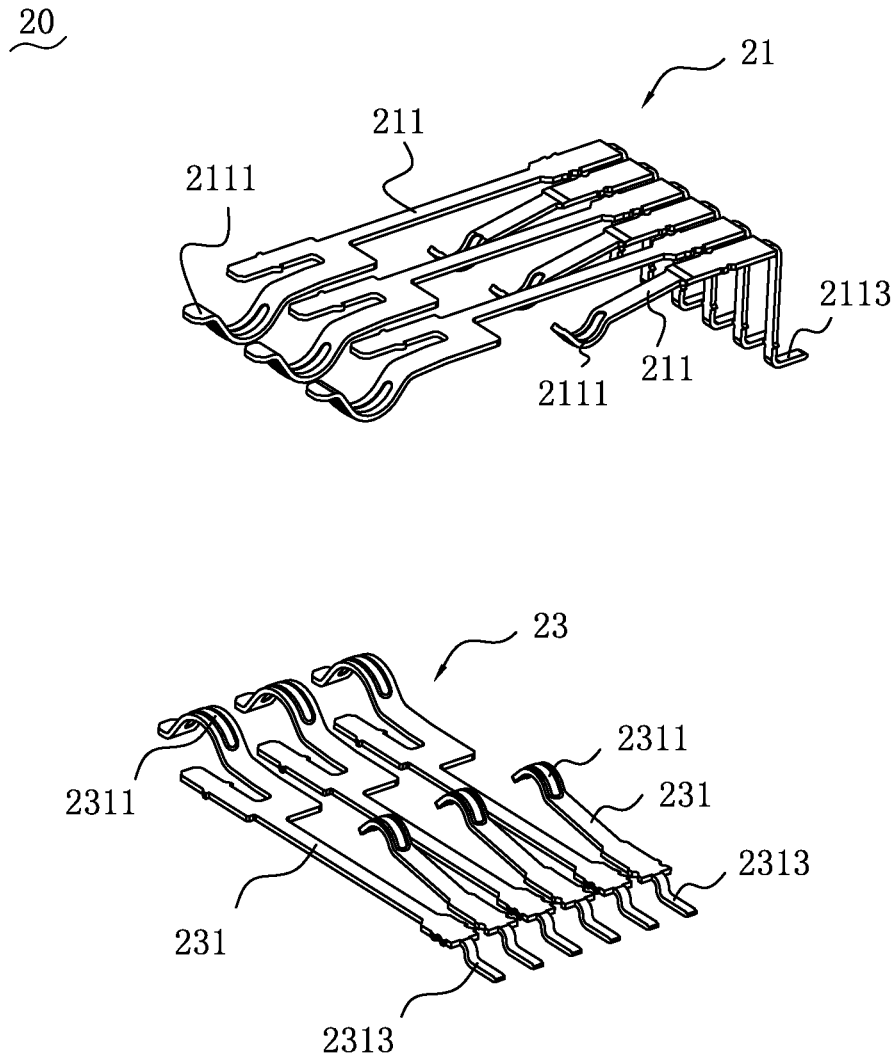
FIG. 8 is a perspective view of electrical contacts of the card connector shown in FIG. 4.

FIG. 8 shows the electrical contacts 20 of the present invention, as shown above. The electrical contacts 20 include the first electrical contact group 21 and the second electrical contact group 23. The structures of the first electrical contact group 21 and the second electrical contact group 23 are generally same.

Please refer to FIG. 8, the first electrical contact group 21 comprises a plurality of unattached electrical contact bodies 211, each of which includes a first contacting end 2111 and a first soldering end 2113. The first contacting end 2111 is a spring arm having flexibility. When the first contacting end 2111 contacts with the first SIM card 31, the first contacting end 2111 may generates elastic deformation to realize the better contact. The first soldering end 2113 protrudes out of the housing 10 for being soldered onto the circuit board. The shape and length of the electrical contact bodies 211 may be designed according to the factual demands, so they cannot be limited to this embodiment. Similarly, the second electrical contact group 23 also comprises a plurality of unattached electrical contact bodies 231, each of which also includes a second contacting end 2311 and a second soldering end 2313.

As described above, the housing 10 of the card connector 1 of the present invention is obtained by mounting the upper and lower housings 11, 13. The card connector 1 has the first opening 120 and the second opening 121, which are separately located on the two adjacent sides of the housing 10 and provided for allowing the two SIM cards 31, 32 to be inserted therein, so that making the mobile phone or other electronic communication devices realize the dual-cards-two-standby function. Furthermore, the card connector 1 of the present invention has a compact structure and saves the inside space of the mobile phone or other electronic communication devices, which are toward light and thin. Additionally, when the two SIM cards 21, 32 are inserted into the housing 10 of the card connector 1 of the present invention, they can stably contact with the electrical contacts 20 so that ensuring the better communications transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector comprising:

a housing comprising an upper housing and a lower housing connected to each other, the upper housing and the lower housing together defining a first opening and a second opening, which are layer-stacked and separately located two adjacent sides of the housing, wherein the first opening and second opening are communicated with each other in the housing to form a receiving cavity for stackedly accommodating at least two electrical cards, the upper housing disposing a plurality of contact-receiving grooves on an inner side of a top wall thereof, and the lower housing also disposing a plurality of contact-receiving grooves on an inner side of a bottom wall thereof, wherein the upper housing includes two engaging portions separately extending downward from two sides of the top wall, and the lower housing including two mating portions separately extending upward from two sides of the bottom wall, and the two mating portions being separately connected to the two engaging portions; and a plurality of electrical contacts being received in the housing and comprising a first electrical contact group and a second electrical contact group, which are separately received in the contact-receiving grooves of the upper housing and the lower housing.

2. The card connector as claimed in claim 1, wherein the two electrical cards are separately inserted into the receiving cavity from the first opening and the second opening along two perpendicular directions.

3. The card connector as claimed in claim 1, wherein one of the engaging portions is corresponding to the second opening, and one of the mating portions is corresponding to the first opening.

4. The card connector as claimed in claim 1, wherein the two engaging portions dispose a plurality of posts, and the two mating portions dispose a plurality of holes corresponding to the posts.

5. The card connector as claimed in claim 1, further comprising two fixing members, which are mounted on the lower housing.

6. The card connector as claimed in claim 5, wherein the lower housing disposes two retaining grooves separately located on two sides thereof for separately receiving the two fixing members, one ends of the two fixing member being separately embedded into the two retaining grooves, and the other ends thereof extending out of the lower housing.

7. A card connector comprising:

a housing comprising an upper housing and a lower housing connected to each other, the upper housing and the lower housing together defining a first opening and a second opening, which are layer-stacked and separately located two adjacent sides of the housing, wherein the first opening and second opening are communicated with each other in the housing to form a receiving cavity for stackedly accommodating at least two electrical cards, the upper housing disposing a plurality of contact-receiving grooves on an inner side of a top wall thereof, and the lower housing also disposing a plurality of contact-receiving grooves on an inner side of a bottom wall thereof;

a plurality of electrical contacts being received in the housing and comprising a first electrical contact group and a second electrical contact group, which are separately received in the contact-receiving grooves of the upper housing and the lower housing; and two fixing members being mounted on the lower housing;

wherein the lower housing disposes two retaining grooves separately located on two sides thereof for separately receiving the two fixing members, one ends of the two fixing member being separately embedded into the two retaining grooves, and the other ends thereof extending out of the lower housing.

* * * * *